US007973746B2

(12) United States Patent
Han et al.

(10) Patent No.: US 7,973,746 B2
(45) Date of Patent: Jul. 5, 2011

(54) PIXEL AND ORGANIC LIGHT EMITTING DISPLAY USING THE SAME

(75) Inventors: Sam-Il Han, Suwon-si (KR); Jin-Tae Jeong, Suwon-si (KR)

(73) Assignee: Samsung Mobile Display Co., Ltd., Yongin (KR)

( * ) Notice: Subject to any disclaimer, the term of this patent is extended or adjusted under 35 U.S.C. 154(b) by 565 days.

(21) Appl. No.: 12/145,771

(22) Filed: Jun. 25, 2008

(65) Prior Publication Data

US 2009/0108763 A1 Apr. 30, 2009

(30) Foreign Application Priority Data

Oct. 25, 2007 (KR) ..... 10-2007-0107851

(51) Int. Cl.
*G09G 3/30* (2006.01)

(52) U.S. Cl. ..... 345/78; 345/77; 345/95; 345/92; 315/169.1; 315/291

(58) Field of Classification Search .... 315/169.1–169.3, 315/291; 345/42, 44–46, 48, 77, 78, 82, 345/92, 95, 204, 214, 690
See application file for complete search history.

(56) References Cited

U.S. PATENT DOCUMENTS

| | | | | |
|---|---|---|---|---|
| 7,180,486 | B2 * | 2/2007 | Jeong | 345/82 |
| 7,193,370 | B2 * | 3/2007 | Kim | 315/169.1 |
| 7,205,966 | B2 * | 4/2007 | Numao | 345/76 |
| 7,696,963 | B2 * | 4/2010 | Choi et al. | 345/82 |
| 7,710,368 | B2 * | 5/2010 | Chung | 345/82 |
| 7,812,796 | B2 * | 10/2010 | Jung | 345/76 |
| 2006/0022305 | A1 | 2/2006 | Yamashita | |
| 2007/0024543 | A1 | 2/2007 | Chung et al. | |

FOREIGN PATENT DOCUMENTS

| | | |
|---|---|---|
| JP | 2006-309104 | 11/2006 |
| KR | 2005-109167 | 11/2005 |
| KR | 2005-109699 | 11/2005 |
| KR | 10-0645695 | 11/2006 |
| KR | 10-0645696 | 11/2006 |
| KR | 10-0658618 | 12/2006 |
| KR | 10-0673760 | 1/2007 |
| KR | 2007-15824 | 2/2007 |
| WO | WO 2005/069266 | 7/2005 |

OTHER PUBLICATIONS

English Abstract of Korean Publication No. 10-2005-0110458.
English Abstract of Korean Publication No. 10-2006-0022799.
English Abstract of Korean Publication No. 10-2006-0112982.
English Abstract of Korean Publication No. 10-2006-0112983.
Office Action issued by the Korean Intellectual Property Office on Apr. 29, 2009.
U.S. Appl. No. 12/181,500, filed Jul. 29, 2008, Sam-Il Han et al., Samsung SDI Co., Ltd.

* cited by examiner

*Primary Examiner* — Haissa Philogene
(74) *Attorney, Agent, or Firm* — Christie, Parker & Hale, LLP

(57) ABSTRACT

A pixel includes a light emitting diode, and a switching circuit that is coupled to a data line and a compensation power source line, and includes a transistor including a control terminal, a first main terminal coupled to a power source line, and a second main terminal coupled to the light emitting diode. The switching circuit generates a control signal based on at least a voltage of a data signal transmitted through the data.

20 Claims, 4 Drawing Sheets

PIXEL AND ORGANIC LIGHT EMITTING DISPLAY USING THE SAME

CROSS-REFERENCE TO RELATED APPLICATIONS

This application claims the benefit of Korean Patent Application 2007-107851 filed on Oct. 25, 2007, in the Korean Intellectual Property Office, the disclosure of which is incorporated herein by reference in its entirety.

BACKGROUND OF THE INVENTION

1. Field of the Invention

Aspects of the invention relate to a pixel and an organic light emitting display using the same, and more particularly to a pixel capable of compensating for the threshold voltage of a transistor of the pixel and for deterioration of the pixel, and an organic light emitting display using the same.

2. Description of the Related Art

Due to recent advances in thin film transistor (TFT) technology, active matrix type flat panel displays that display images using TFTs have become widely used. In particular, organic light emitting displays having high emission efficiency, brightness, and response speed and a large viewing angle have been in the spotlight recently.

An organic light emitting display displays an image using a plurality of organic light emitting diodes (OLEDs). An OLED includes an anode electrode, a cathode electrode, and an organic light emitting layer disposed between the anode electrode and the cathode electrode to emit light resulting from recombination of electrons and holes.

FIG. 1 is a circuit diagram of a pixel used in an organic light emitting display according to the related art. Referring to FIG. 1, the pixel includes a first transistor T1, a second transistor T2, a capacitor Cst, and an organic light emitting diode (OLED).

The source of the first transistor T1 is coupled to a first power source ELVDD, the drain of the first transistor T1 is coupled to the OLED, and the gate of the first transistor T1 is coupled to a node N. The source of the second transistor T2 is coupled to a data line Dm, the drain of the second transistor T2 is coupled to the node N, and the gate of the second transistor T2 is coupled to a scan line Sn. The first electrode of the capacitor Cst is coupled to the first power source ELVDD, and the second electrode of the capacitor Cst is coupled to the node N. The OLED includes an anode electrode, a cathode electrode, and a light emitting layer disposed between the anode electrode and the cathode electrode. The anode electrode is coupled to the drain of the first transistor T1, and the cathode electrode is coupled to a second power source ELVSS. When current flows from the anode electrode to the cathode electrode in the OLED, the light emitting layer emits light having a brightness that depends on the magnitude of the current flowing in the OLED. The following Equation 1 expresses the current that flows in the OLED.

$$I_d = \frac{\beta}{2}(\mathrm{ELVDD} - Vdata - Vth)^2 \quad (1)$$

where $I_d$ is the current that flows in the OLED, Vdata is the voltage of a data signal applied to the data line Dm, ELVDD is the voltage of the first power source applied to the source of the first transistor T1, Vth is the threshold voltage of the first transistor T1, and β is a constant.

Referring to Equation 1, the current that flows in the OLED depends on the voltage ELVDD of the first power source, the voltage Vdata of the data signal, and the threshold voltage Vth of the first transistor T1. Therefore, the current that flows in the OLED varies in accordance to the voltage deviation of the first power source ELVDD applied to each pixel and the deviation of the threshold voltage of the first transistor T1, thereby causing a deviation in the brightness of the OLED. In addition, when current flows in the OLED for a long time, the OLED deteriorates so that the brightness of the light that is generated varies even though the same current flows, thereby deteriorating picture quality.

SUMMARY OF THE INVENTION

Aspects of the invention relate to providing a pixel capable of compensating for a threshold voltage of a transistor of the pixel and preventing picture quality from deteriorating due to the deterioration of an organic light emitting diode of the pixel, and an organic light emitting display using the same.

According to an aspect of the invention, a pixel includes an organic light emitting diode (OLED) including an anode electrode, a cathode electrode, and a light emitting layer disposed between the anode electrode and the cathode electrode; a first transistor including a source coupled to a first power source line, a drain coupled to a first node, and a gate coupled to a second node; a second transistor including a source coupled to a data line, drain coupled to a third node, and a gate coupled to a first scan line; a third transistor including a source coupled to the first node, a drain coupled to the second node, and a gate coupled to a second scan line; a fourth transistor including a source coupled to the anode electrode, a drain coupled to the third node, and a gate coupled to the second scan line; a fifth transistor including a source coupled to a compensation power source line, a drain coupled to the third node, and a gate coupled to a third scan line; a sixth transistor including a source coupled to the first node, a drain coupled to the anode electrode, and a gate coupled to an emission control line; a first capacitor including a first electrode coupled to the first power source line, and a second electrode coupled to the second node; and a second capacitor including a first electrode coupled to the third node, and a second electrode coupled to the second node.

According to an aspect of the invention, an organic light emitting display includes a pixel unit including a plurality of pixels each arranged to receive a first scan signal, a second scan signal, a third scan signal, an emission control signal, and a data signal to display an image; and a scan driver to generate the first scan signal, the second scan signal, the third scan signal, and the emission control signal. At least one pixel of the plurality of pixels includes an organic light emitting diode (OLED) including an anode electrode, a cathode electrode, and a light emitting layer disposed between the anode electrode and the cathode electrode; a first transistor including a source coupled to a first power source line, a drain coupled to a first node, and a gate coupled to a second node; a second transistor including a source coupled to a data line, a drain coupled to a third node, and a gate coupled to a first scan line; a third transistor including a source coupled to the first node, a drain coupled to the second node, and a gate coupled to a second scan line; a fourth transistor including a source coupled to the anode electrode, a drain coupled to the third node, and a gate coupled to the second scan line; a fifth transistor including a source coupled to a compensation power source line, a drain coupled to the third node, and a gate coupled to a third scan line; a sixth transistor including a source coupled to the first node, a drain coupled to the anode electrode, and a gate coupled to an emission control line; a first capacitor including a first electrode coupled to the first power source line, and a second electrode coupled to the second node; and a second capacitor including a first electrode coupled to the third node, and a second electrode coupled to the second node.

According to an aspect of the invention, a pixel includes a switching circuit including a first transistor including a control terminal, a first main terminal coupled to a first power source line, and a second main terminal; a first capacitor including a first electrode coupled to the first power source line, and a second electrode coupled to the control terminal of the first transistor; and a second capacitor including a first electrode coupled to a data line and a compensation power source line, and a second electrode coupled to the control terminal of the first transistor. The pixel further includes a light emitting diode including a first terminal coupled to the second main terminal of the first transistor, and a second terminal coupled to a second power source line. The switching circuit generates a control signal based on at least a voltage of a data signal transmitted through the data line, a compensation power source voltage applied to the compensation power source line, and a voltage drop of the light emitting diode, and applies the control signal to the control terminal of the first transistor to control a current flowing in the light emitting diode so that the current varies in accordance with the voltage of the data signal and is independent of variations in the voltage drop of the light emitting diode.

Additional aspects and/or advantages of the invention will be set forth in part in the description that follows and, in part, will be obvious from the description, or may be learned by practice of the invention.

BRIEF DESCRIPTION OF THE DRAWINGS

The above and/or other aspects and advantages of the invention will become apparent and more readily appreciated from the following description of embodiments of the invention, taken in conjunction with the accompanying drawings of which.

DETAILED DESCRIPTION OF THE EMBODIMENTS

Figure 1:
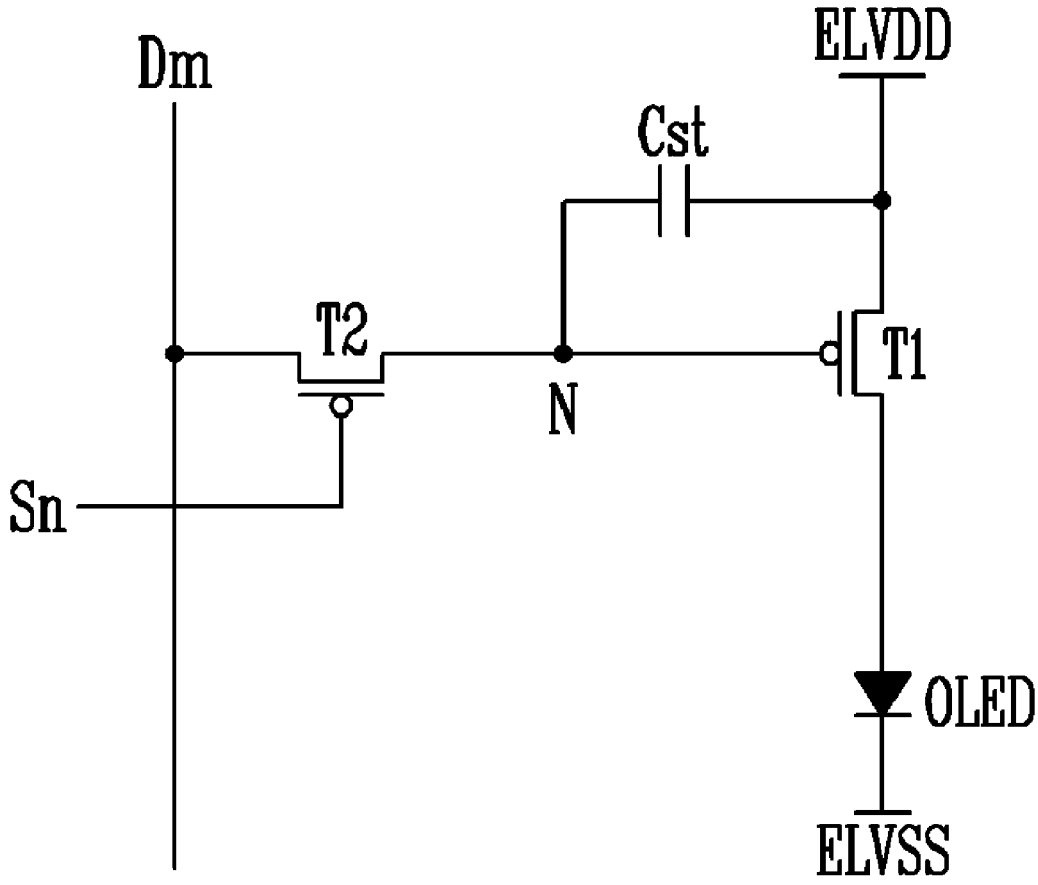
FIG. 1 (RELATED ART)
FIG. 1 is a circuit diagram of a pixel used in an organic light emitting display according to the related art.

Reference will now be made in detail to the embodiments of the invention, examples of which are shown in the accompanying drawings, wherein like reference numerals refer to like elements throughout. The embodiments are described below in order to explain the invention by referring to the figures.

When one element is described as being coupled to another element in the following description, this indicates that the one element may be directly connected to the other element, or may be indirectly connected to the other element through one or more intervening elements.

Figure 2:
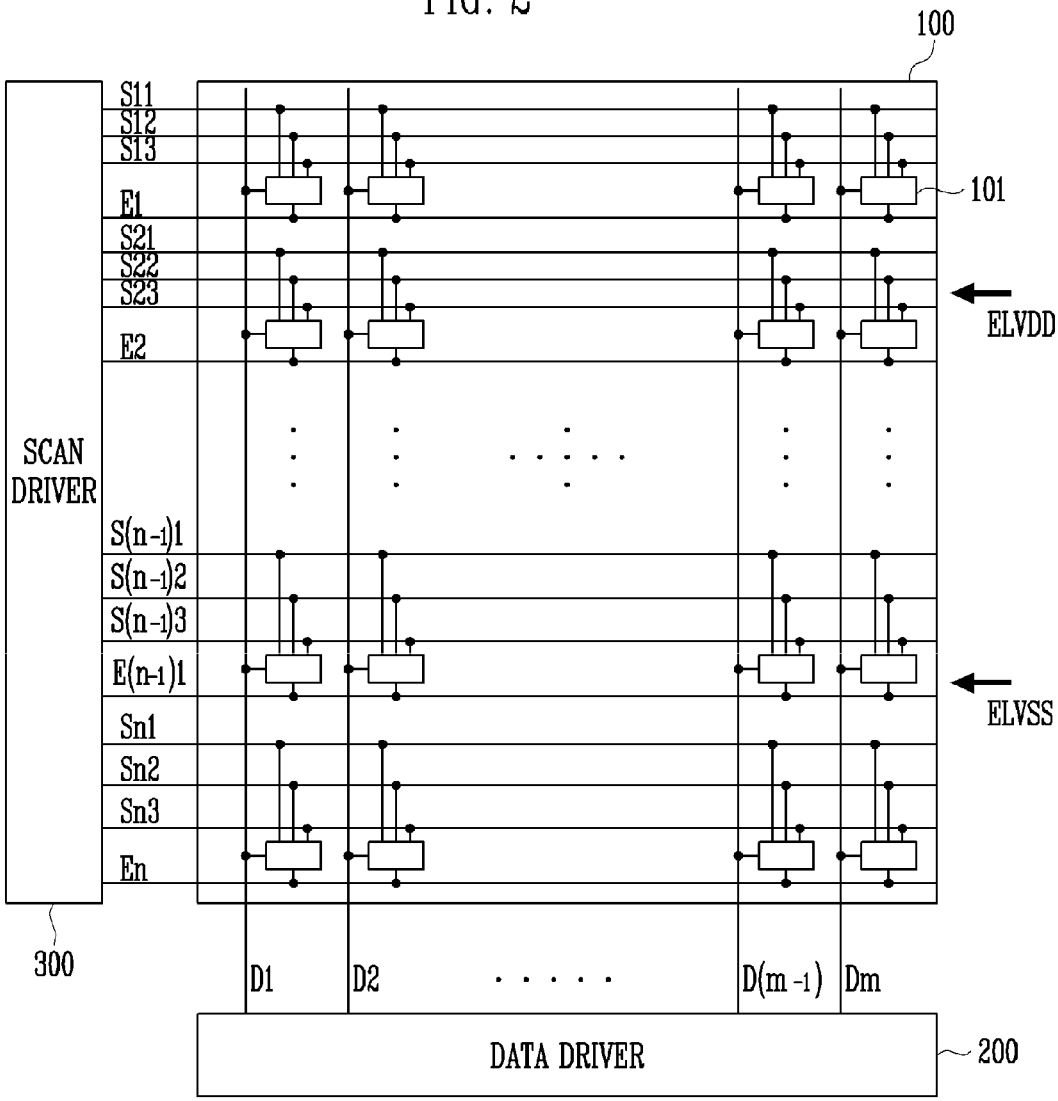
FIG. 2 is a circuit diagram of an organic light emitting display according to an aspect of the invention.

FIG. 2 is a circuit diagram of an organic light emitting display according to an aspect of the invention. Referring to FIG. 2, the organic light emitting display includes a pixel unit 100, a data driver 200, and a scan driver 300. The pixel unit 100 includes a plurality of pixels 101, and each of the pixels 101 includes an organic light emitting diode (OLED) (not shown) that emits light having a brightness that depends on the magnitude of a current flowing in the OLED. In addition, 3n scan lines S11, S12, S13, S21, S22, S23, . . . , S(n−1)1, S(n−1)2, S(n−1)3, Sn1, Sn2, and Sn3 for transmitting scan signals are formed in a row direction, n emission control lines E1, E2, . . . , E(n−1), and En for transmitting emission control signals are formed in the row direction, and m data lines D1, D2, . . . , D(m−1), and Dm for transmitting data signals are formed in a column direction. In addition, a first power source ELVDD and a second power source ELVSS provide power from the outside for driving the pixel unit 100. Therefore, in the pixel unit 100, driving currents that flow in the OLEDs of the pixels 101 are generated by the scan signals, the emission control signals, the data signals, the first power source ELVDD, and the second power source ELVSS so that the OLEDs of the pixels 101 emit light having a brightness that depends on the driving currents to display an image.

As shown in FIG. 2, three scan lines are coupled to one pixel 101 so that three scan signals are transmitted to the pixel 101. When one scan signal is transmitted to the pixel 101, the voltage drop of the OLED of the pixel 101 is compensated for. When another scan signal is transmitted to the pixel 101, a threshold voltage of a transistor of the pixel 101 is compensated for. When still another scan signal is transmitted to the pixel 101, a data signal is transmitted to the pixel 101 for use in generating a driving current for driving the OLED of the pixel 101. Therefore, the driving current can be controlled according to the voltage drop of the OLED and the threshold voltage of the transistor.

The data driver 200 for applying data signals to the pixel unit 100 receives video data having red, blue, and green components to generate the data signals. The data driver 200 is coupled to the data lines D1, D2, . . . , D($m^{-1}$), and Dm of the pixel unit 100 to apply the generated data signals to the pixel unit 100.

The scan driver 300 for applying scan signals and emission control signals to the pixel unit 100 is coupled to the scan lines S11, S12, S13, S21, S22, S23, . . . , S(n−1)1, S(n−1)2, S(n−1)3, Sn1, Sn2, and Sn3 and the emission control lines E1, E2, . . . , E(n−1), and En to transmit the scan signals and the emission control signals to specific rows of the pixel unit 100. The data signals output from the data driver 200 are transmitted to the pixels 101 to which the scan signals are being transmitted so that the driving currents are generated by the pixels 101, and the generated driving currents flow to the OLEDs under control of the emission control signals. According to an aspect of the invention, three scan lines coupled to one pixel 101 are adjacent to each other among the scan lines S11, S12, S13, S21, S22, S23, . . . , S(n−1)1, S(n−1)2, S(n−1)3, Sn1, Sn2, and Sn3. However, it is understood that the invention is not limited to such an arrangement. Any arrangement will work as long as three scan lines are coupled to one pixel 101. For example, a current scan line and two preceding scan lines that are adjacent to each other can be coupled to one pixel 101.

Figure 3:
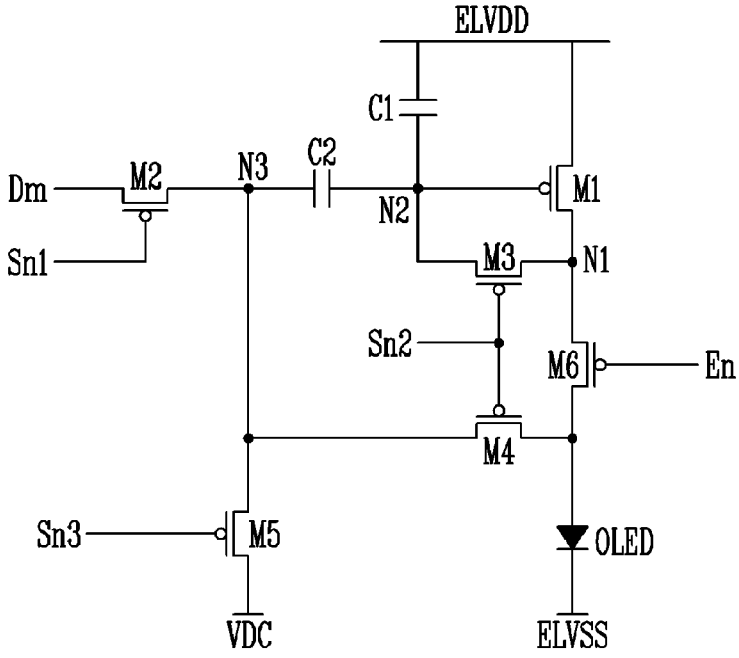
FIG. 3 is a circuit diagram of a pixel according to according to an aspect of the invention used in the organic light emitting display of FIG. 2.

FIG. 3 is a circuit diagram of a pixel according to an aspect of the invention used in the organic light emitting display of FIG. 2. Referring to FIG. 3, a pixel includes a first transistor M1, a second transistor M2, a third transistor M3, a fourth transistor M4, a fifth transistor M5, a sixth transistor M6, a first capacitor C1, a second capacitor C2, and an organic light emitting diode OLED. FIG. 3 shows PMOS MOSFET transistors, but it is understood that other types of transistors may be used.

The source of the first transistor M1 is coupled to a first power source line ELVDD, the drain of the first transistor M1 is coupled to a first node N1, and the gate of the first transistor M1 is coupled to a second node N2. Therefore, the first transistor M1 controls the magnitude of the driving current of the pixel that flows from its source to its drain in accordance with the voltage of the second node N2.

The source of the second transistor M2 is coupled to the data line Dm, the drain of the second transistor M2 is coupled to a third node N3, and the gate of the second transistor M2 is coupled to the first scan line Sn1. The second transistor M2 transmits the data signal transmitted through the data line Dm to the pixel in accordance with the scan signal transmitted through the first scan line Sn1.

The source of the third transistor M3 is coupled to the first node N1, the drain of the third transistor M3 is coupled to the second node N2, and the gate of the third transistor M3 is coupled to the second scan line Sn2. The third transistor M3 makes the voltages of the first node N1 and the second node N2 equal to each other in accordance with the scan signal transmitted through the second scan line Sn2 so that the first transistor M1 operates as a diode-connected transistor.

The source of the fourth transistor M4 is coupled to the anode electrode of the OLED, the drain of the fourth transistor M4 is coupled to a first electrode of the second capacitor C2 at the third node N3, and the gate of the fourth transistor M4 is coupled to the second scan line Sn2. Therefore, the fourth transistor M4 transmits a voltage drop of the OLED, i.e., a voltage between the anode electrode and the cathode electrode of the OLED when a current is flowing in the OLED, to the first electrode of the second capacitor C2 at the third node N3 in accordance with the scan signal transmitted through the second scan line Sn2.

The source of the fifth transistor M5 is coupled to a compensation power source line $V_{DC}$, the drain of the fifth transistor M5 is coupled to the third node N3, and the gate of the fifth transistor M5 is coupled to the third scan line Sn3. Therefore, the fifth transistor M5 transmits the voltage of the compensation power source line $V_{DC}$ to the third node N3 in accordance with the scan signal transmitted through the third scan line Sn3.

The source of the sixth transistor M6 is coupled to the first node N1, the drain of the sixth transistor M6 is coupled to the anode electrode of the OLED, and the gate of the sixth transistor M6 is coupled to the emission control line En. Therefore, the sixth transistor M6 transmits the driving current from the first transistor M1 to the OLED in accordance with the emission control signal transmitted through the emission control line En.

A first electrode of the first capacitor C1 is coupled to the first power source line ELVDD, and a second electrode of the first capacitor C1 is coupled to the second node N2 to enable the first capacitor C1 to maintain the voltage of the second node N2.

The first electrode of the second capacitor C2 is coupled to the third node N3, and a second electrode of the second capacitor C2 is coupled to the second node N2 so that the first capacitor C1 and the second capacitor C2 are connected in series at the second node N2 to enable the voltage of the second node N2 to be controlled in accordance with the voltage of the third node N3 and the voltage-dividing effect of the series connection of the first capacitor C1 and the second capacitor C2.

The OLED includes an anode electrode, a cathode electrode, and a light emitting layer disposed between the anode electrode and the cathode electrode to emit light when a current flows from the anode electrode to the cathode electrode. The brightness of the light emitted by the OLED varies in accordance with the magnitude of the current that flows in the OLED, thereby enabling the OLED to display gray scales.

Figure 4:
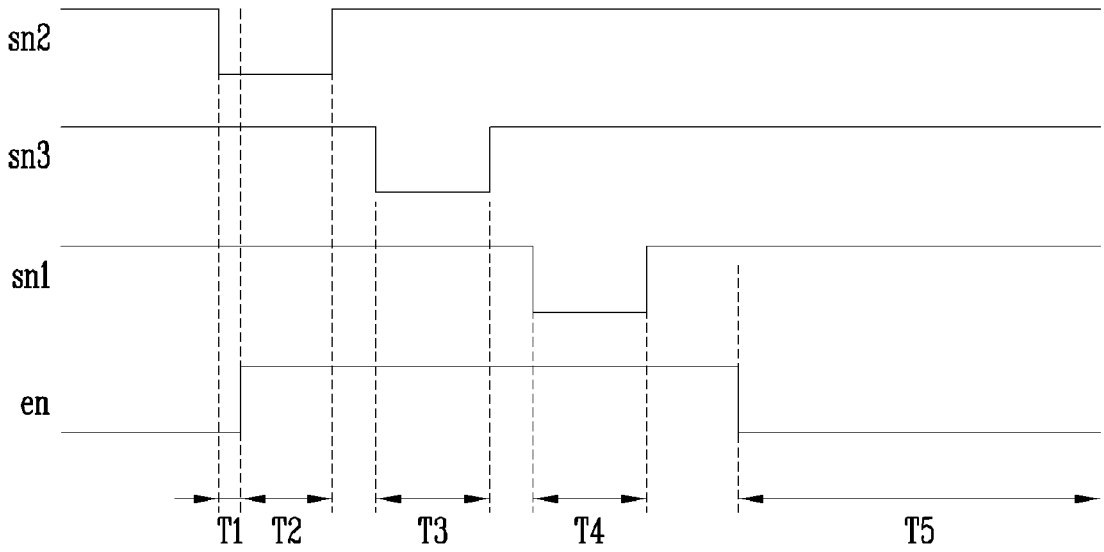
FIG. 4 is a timing diagram of signals transmitted to the pixel of FIG. 3.

FIG. 4 is a timing diagram of the signals transmitted to the pixel of FIG. 3. Referring to FIG. 4, a pixel is coupled to three scan lines Sn1, Sn2, and Sn3. The scan signal transmitted through the first scan line Sn1 is referred to as a first scan signal Sn1, the scan signal transmitted through the second scan line Sn2 is referred to as a second scan signal Sn2, and the scan signal transmitted through the third scan line Sn3 is referred to as a third scan signal Sn3. In addition, the data signal is transmitted to the pixel through the data line Dm, and the emission control signal en is transmitted to the pixel through the emission control line En.

First, in a period T1, the second scan signal Sn2 and the emission control signal en are in a low state so that the third transistor M3, the fourth transistor M4, and the sixth transistor M6 are turned on. The third transistor M3 being turned on causes the first transistor M1 to operate as a diode-connected transistor so that a current flows from the first power source ELVDD to the OLED via the first transistor M1 and the sixth transistor M6. At this time, due to the characteristic of the OLED, the current flowing in the OLED produces a voltage drop (hereinafter referred to as Vel) in the OLED that appears as a voltage on the anode electrode of the OLED. The voltage drop Vel is transmitted to the third node N3 by the fourth transistor M4 to initialize the first capacitor C1 and the second capacitor C2.

In a period T2, the second scan signal Sn2 is in a low state and the emission control signal is in a high state so that a current does not flow in the OLED.

Since the second scan signal Sn2 is in the low state in the period T2, the third transistor M3 and the fourth transistor M4 are still turned on. Since the third transistor M3 is still turned on, the first transistor M1 is still operating as a diode-connected transistor. The voltage between the source and the drain of a diode-connected transistor is equal to the threshold voltage of the transistor, plus a value that is a function of the current flowing through the transistor. Since the sixth transistor M6 is turned off during the period T2 because the emission control signal is in the high state, no current flows through the diode-connected first transistor M1 during the period T2, such that the voltage between the source and the drain of the diode-connected first transistor M1 during the period T2 is equal to the threshold voltage of the first transistor M1. Therefore, the threshold voltage of the first transistor M1 is transmitted to the second node N2 during the period T2, thereby causing a voltage expressed by the following Equation 2 to be applied to the second node N2:

$$Vg=ELVDD+Vth \quad (2)$$

where Vg is the voltage of the second node N2, ELVDD is the voltage of the first power source, and Vth is the threshold voltage of the first transistor M1.

In a period T3, the fifth transistor M5 is turned on by the third scan signal Sn3 to transmit the voltage of the compensation power source line $V_{DC}$ to the third node N3 so that the voltage of the third node N3 becomes a voltage $V_{DC}$. Therefore, the voltage of the second node changes from Vel to $V_{DC}$. As the voltage of the third node N3 changes, the voltage of the second node N2 changes by an amount that is proportional to $V_{DC}$-Vel in accordance with the voltage-dividing effect of the series connection of the first capacitor C1 and the second capacitor C2. Therefore, a voltage expressed by the following Equation 3 appears on the second node N2:

$$Vg = \text{ELVDD} + Vth + \left(\frac{C2}{C1 + C2}\right)(V_{DC} - Vel) \tag{3}$$

In a period T4, the second transistor M2 is turned on by the first scan signal Sn1 to transmit a data signal received through the data line Dm to the third node N3 so that the voltage of the third node N3 becomes a voltage (hereinafter referred to as Vdata) of the data signal. Therefore, the voltage of the third node N3 changes from $V_{DC}$ to Vdata. As the voltage of the third node N3 changes, the voltage of the second node N2 changes by an amount that is proportional to Vdata-$V_{DC}$ in accordance with the voltage-dividing effect of the series connection of the first capacitor C1 and the second capacitor C2. Therefore, a voltage expressed by the following Equation 4 appears on the second node N2:

$$Vg = \text{ELVDD} + Vth + \left(\frac{C2}{C1 + C2}\right)(V_{DC} - Vel) + \left(\frac{C2}{C1 + C2}\right)(Vdata - V_{DC}) \tag{4}$$

Equation 4 reduces to the following Equation 5:

$$Vg = \text{ELVDD} + Vth + \left(\frac{C2}{C1 + C2}\right)(Vdata - Vel) \tag{5}$$

Finally, in a period T5, the sixth transistor M6 is turned on by the emission control signal en so that a driving current flows through the OLED via the first transistor M1 and the sixth transistor M6, thereby causing the OLED to emit light. The driving current flowing through the OLED is equal to a drain current $I_d$ of the first transistor M1, which is expressed by the following Equation 6:

$$I_d = \frac{\beta}{2}(Vgs - Vth)^2 \tag{6}$$

where β is a constant, Vgs is the gate-to-source voltage of the first transistor M1, and Vth is the threshold voltage of the first transistor M1.

For a MOSFET, the constant β in Equation 6 is expressed by the following Equation 7:

$$\beta = \mu \cdot C_{OX} \cdot \frac{W}{L} \tag{7}$$

where β is a surface mobility of the first transistor M1, $C_{OX}$ is a gate oxide capacitance per unit area of the first transistor M1, W is a gate width of the first transistor M1, and L is a gate length of the first transistor M1.

The gate-to-source voltage Vgs in Equation 7 is the voltage difference between the gate voltage Vg of the first transistor M1, which, as can be seen from FIG. 3, is the voltage of the second node N2 that is expressed by Equation 5 above, and the source voltage Vs of the first transistor M1, which, as can be seen from FIG. 3, is ELVDD. Thus, the gate-to-source voltage Vgs of the first transistor M1 is expressed by the following Equation 8:

$$\begin{aligned} Vgs &= Vg - Vs \\ &= \left[\text{ELVDD} + Vth + \left(\frac{C2}{C1 + C2}\right)(Vdata - Vel)\right] - \text{ELVDD} \end{aligned} \tag{8}$$

Equation 8 reduces to the following Equation 9:

$$Vgs = Vth + \left(\frac{C2}{C1 + C2}\right)(Vdata - Vel) \tag{9}$$

Combining Equations 6 and 9 results in the following Equation 10:

$$I_d = \frac{\beta}{2}\left[\left[Vth + \left(\frac{C2}{C1 + C2}\right)(Vdata - Vel)\right] - Vth\right]^2 \tag{10}$$

Equation 10 reduces to the following Equation 11:

$$I_d = \frac{\beta}{2}\left[\left(\frac{C2}{C1 + C2}\right)(Vdata - Vel)\right]^2 \tag{11}$$

As can be seen from Equations 8, 10, and 11, the driving current $I_d$ that flows in the OLED is independent of the voltage ELVDD of the first power source and the threshold voltage Vth of the first transistor M1 because the voltage ELVDD was canceled out in Equation 8, and the threshold voltage Vth was canceled out in Equation 10. In addition, as the OLED deteriorates, the voltage drop Vel changes, and the driving current $I_d$ that flows in the OLED can be controlled in accordance with the changed voltage drop Vel because the current voltage drop Vel is transmitted to the third node N3 during the period T1 each time the pixel is driven. Therefore, it is possible to compensate for the deterioration of the picture quality caused by the deterioration of the OLED.

Figure 5:
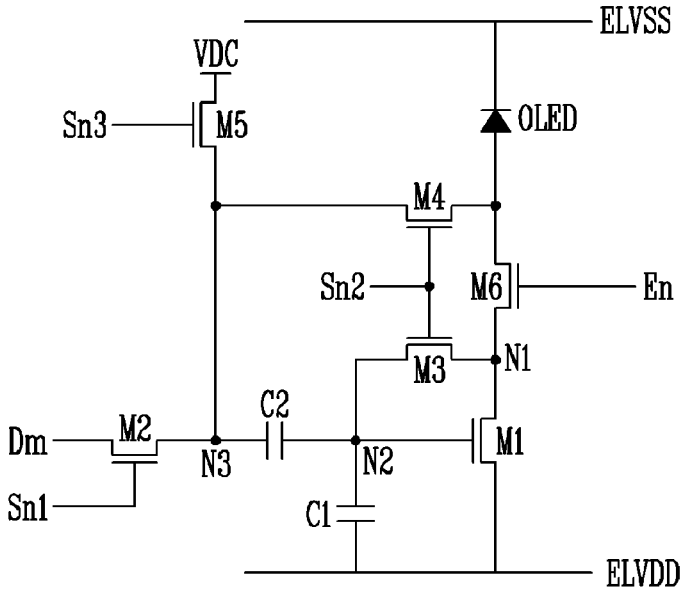
FIG. 5 is a circuit diagram of a pixel according to an aspect of the invention used in the organic light emitting display of FIG. 2.
Figure 6:
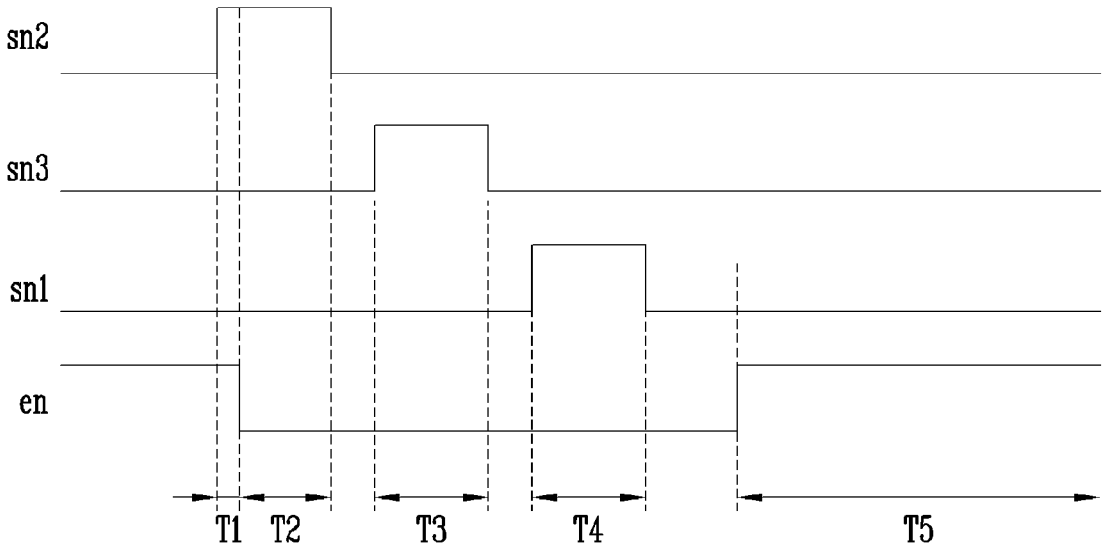
FIG. 6 is a timing diagram of signals transmitted to the pixel of FIG. 5.

FIG. 5 is a circuit diagram of a pixel according to an aspect of the invention used in the organic light emitting display of FIG. 2. FIG. 6 is a timing diagram of signals transmitted to the pixel of FIG. 5. In FIG. 5, the transistors of the pixel are NMOS MOSFET transistors, rather than PMOS MOSFET transistors as shown in FIG. 3, although it is understood that other types of transistors can be used. Therefore, when the signals of FIG. 6, which are obtained by inverting the signals of FIG. 4, are transmitted to the pixel of FIG. 5, the pixel of FIG. 5 operates in the same way as the pixel of FIG. 3.

In a pixel according to aspects of the invention and an organic light emitting display using the same, deviations in a threshold voltage of a transistor that controls a driving current of an OLED of the pixel, a voltage drop of the OLED of the pixel, and a power source voltage are compensated for to prevent the picture quality from deteriorating.

Although several embodiments of the invention have been shown and described, it would be appreciated by those skilled in the art that changes may be made in these embodiments without departing from the principles and spirit of the invention, the scope of which is defined in the claims and their equivalents.

What is claimed is:

1. A pixel comprising:

an organic light emitting diode (OLED) comprising an anode electrode, a cathode electrode, and a light emitting layer disposed between the anode electrode and the cathode electrode;

a first transistor comprising a source coupled to a first power source line, a drain coupled to a first node, and a gate coupled to a second node;

a second transistor comprising a source coupled to a data line, a drain coupled to a third node, and a gate coupled to a first scan line;

a third transistor comprising a source coupled to the first node, a drain coupled to the second node, and a gate coupled to a second scan line;

a fourth transistor comprising a source coupled to the anode electrode, a drain coupled to the third node, and a gate coupled to the second scan line;

a fifth transistor comprising a source coupled to a compensation power source line, a drain coupled to the third node, and a gate coupled to a third scan line;

a sixth transistor comprising a source coupled to the first node, a drain coupled to the anode electrode, and a gate coupled to an emission control line;

a first capacitor comprising a first electrode coupled to the first power source line, and a second electrode coupled to the second node; and a second capacitor comprising a first electrode coupled to the third node, and a second electrode coupled to the second node.

2. The pixel of claim 1, wherein:

the fifth transistor is turned on by a scan signal transmitted through the third scan line after the third transistor and the fourth transistor have been turned on by a scan signal transmitted through the second scan line; and the second transistor is turned on by a scan signal transmitted through the first scan line after the fifth transistor has been turned on by the scan signal transmitted through the third scan line.

3. The pixel of claim 1, wherein the first capacitor and the second capacitor are initialized by a voltage that is transmitted to the third node during a period in which the fourth transistor is turned on by a signal transmitted through the second scan line.

4. The pixel of claim 1, wherein the first capacitor and the second capacitor receive a voltage drop of the OLED at the third node to control a voltage of the second node.

5. The pixel of claim 1, wherein the fifth transistor is turned on by a scan signal transmitted through the third scan line to transmit a voltage of the compensation power source line to the third node to control a voltage of the second node.

6. The pixel of claim 1, wherein a current expressed by the following equation flows in the OLED when the sixth transistor is turned on by an emission control signal transmitted through the emission control line after the second transistor has been turned on by a scan signal transmitted through the first scan line to transmit a data signal transmitted through the data line to the third node, thereby changing a voltage at the second node:

$$I_d = \frac{\beta}{2}\left[\left(\frac{C2}{C1 + C2}\right)(Vdata - Vel)\right]^2$$

where $I_d$ is the current flowing in the OLED, β is a constant, C1 is a capacitance of the first capacitor, C2 is a capacitance of the second capacitor, Vdata is a voltage of the data signal, and Vel is a voltage drop of the OLED.

7. An organic light emitting display comprising:

a pixel unit comprising a plurality of pixels each arranged to receive a first scan signal, a second scan signal, a third scan signal, an emission control signal, and a data signal to display an image; and a scan driver to generate the first signal, the second signal, the third scan signal, and the emission control signal;

wherein at least one pixel of the plurality of pixels comprises:

an organic light emitting diode (OLED) comprising an anode electrode, a cathode electrode, and a light emitting layer disposed between the anode electrode and the cathode electrode;

a first transistor comprising a source coupled to a first power source line, a drain coupled to a first node, and a gate coupled to a second node;

a second transistor comprising a source coupled to a data line, a drain coupled to a third node, and a gate coupled to a first scan line;

a third transistor comprising a source coupled to the first node, a drain coupled to the second node, and a gate coupled to a second scan line;

a fourth transistor comprising a source coupled to the anode electrode, a drain coupled to the third node, and a gate coupled to the second scan line;

a fifth transistor comprising a source coupled to a compensation power source line, a drain coupled to the third node, and a gate coupled to a third scan line;

a sixth transistor comprising a source coupled to the first node, a drain coupled to the anode electrode, and a gate coupled to an emission control line;

a first capacitor comprising a first electrode coupled to the first power source line, and a second electrode coupled to the second node; and a second capacitor comprising a first electrode coupled to the third node, and a second electrode coupled to the second node.

8. The organic light emitting display of claim 7, wherein:

the fifth transistor is turned on by the third scan signal transmitted through the third scan line after the third transistor and the fourth transistor have been turned on by the second scan signal transmitted through the second scan line; and the second transistor is turned on by the first scan signal transmitted through the first scan line after the fifth transistor has been turned on by the third scan signal transmitted through the third scan line.

9. The organic light emitting display of claim 7, wherein the first capacitor and the second capacitor are initialized by a voltage that is transmitted to the third node during a period in which the fourth transistor is turned on by the second scan signal transmitted through the second scan line.

10. The organic light emitting display of claim 7, wherein the first capacitor and the second capacitor receive a voltage drop of the OLED at the third node to control a voltage of the second node.

11. The organic light emitting display of claim 7, wherein the fifth transistor is turned on by the third scan signal transmitted through the third scan line to transmit a voltage of the compensation power source line to the third node to control a voltage of the second node.

12. The organic light emitting display of claim 7, wherein:

the scan driver independently generates the first scan signal, the second scan signal, and the third scan signal; and the first scan signal is transmitted through the first scan line, the second scan signal is transmitted through the second scan line, and the third scan signal is transmitted through the third scan line.

13. The organic light emitting display of claim 7, wherein a current expressed by the following equation flows in the OLED when the sixth transistor is turned on by the emission control signal transmitted through the emission control line after the second transistor has been turned on by the first scan signal transmitted through the first scan line to transmit the data signal transmitted through the data line to the third node, thereby changing a voltage at the second node:

$$I_d = \frac{\beta}{2}\left[\left(\frac{C2}{C1 + C2}\right)(Vdata - Vel)\right]^2$$

where $I_d$ is the current flowing in the OLED, β is a constant, C1 is a capacitance of the first capacitor, C2 is a capacitance of the second capacitor, Vdata is a voltage of the data signal, and Vel is a voltage drop of the OLED.

14. A pixel comprising:

a switching circuit comprising:

a first transistor comprising a control terminal, a first main terminal coupled to a first power source line, and a second main terminal;

a first capacitor comprising a first electrode coupled to the first power source line, and a second electrode coupled to the control terminal of the first transistor; and a second capacitor comprising a first electrode coupled to a data line and a compensation power source line, and a second electrode coupled to the control terminal of the first transistor; and a light emitting diode comprising a first terminal coupled to the second main terminal of the first transistor, and a second terminal coupled to a second power source line;

wherein the switching circuit generates a control signal based on at least a voltage of a data signal transmitted through the data line, a compensation power source voltage applied to the compensation power source line, and a voltage drop of the light emitting diode, and applies the control signal to the control terminal of the first transistor to control a current flowing in the light emitting diode so that the current varies in accordance with the voltage of the data signal and is independent of variations in the voltage drop of the light emitting diode.

15. The pixel of claim 14, wherein the current flowing in the light emitting diode is also independent of variations in a first power source voltage applied to the first power source line and a threshold voltage of the first transistor.

16. The pixel of claim 14, wherein the first transistor is a MOSFET comprising a gate constituting the control terminal, a source constituting the first main terminal, and a drain constituting the second main terminal.

17. The pixel of claim 14, wherein the switching circuit further comprises a second transistor comprising a control terminal, a first main terminal coupled to the first terminal of the light emitting diode, and a second main terminal coupled to the first electrode of the second capacitor to transmit a voltage drop of the light emitting diode to the first electrode of the second capacitor in response to a scan signal applied to the control terminal of the second transistor.

18. The pixel of claim 17, wherein the switching circuit further comprises a third transistor comprising a control terminal, a first main terminal coupled to the compensation power source line, and a second main terminal coupled to the first electrode of the second capacitor to transmit the compensation power source voltage applied to the compensation power source voltage line to the first electrode of the second capacitor in response to a scan signal applied to the control terminal of the second capacitor.

19. The pixel of claim 14, wherein the current flowing in the light emitting diode is expressed by the following equation:

$$I_d = \frac{\beta}{2}\left[\left(\frac{C2}{C1 + C2}\right)(Vdata - Vel)\right]^2$$

where $I_d$ is the current flowing in the light emitting diode, β is a constant, C1 is a capacitance of the first capacitor, C2 is a capacitance of the second capacitor, Vdata is a voltage of the data signal, and Vel is a voltage drop of the light emitting diode.

20. The pixel of claim 14, wherein the switching circuit receives a first scan signal, a second scan signal, a third scan signal that are independently generated for the pixel, and generates the control signal in response to the first scan signal, the second scan signal, and the third scan signal.

* * * * *